US010508804B2

(12) United States Patent
Jiang

(10) Patent No.: US 10,508,804 B2
(45) Date of Patent: Dec. 17, 2019

(54) STAGE LIGHTING FIXTURE THERMAL SYSTEM CAPABLE OF DYNAMICALLY ADJUSTING AIR FLOW DELIVERY

(71) Applicant: Guangzhou Haoyang Electronic Co., Ltd., Guangzhou (CN)

(72) Inventor: Weikai Jiang, Guangzhou (CN)

(73) Assignee: Guangzhou Haoyang Electronic Co., Ltd. (CN)

( * ) Notice: Subject to any disclaimer, the term of this patent is extended or adjusted under 35 U.S.C. 154(b) by 54 days.

(21) Appl. No.: 15/856,852

(22) Filed: Dec. 28, 2017

(65) Prior Publication Data

US 2018/0142877 A1 May 24, 2018

Related U.S. Application Data

(63) Continuation of application No. PCT/CN2016/099610, filed on Sep. 21, 2016.

(30) Foreign Application Priority Data

Aug. 23, 2016 (CN) ..... 2016 1 0706284

(51) Int. Cl.
*F21V 29/61* (2015.01)
*F21V 29/503* (2015.01)
(Continued)

(52) U.S. Cl.
CPC ..... *F21V 29/61* (2015.01); *F21V 29/503* (2015.01); *F21V 29/67* (2015.01); *F21V 29/677* (2015.01);
(Continued)

(58) Field of Classification Search
CPC ..... F21V 29/61; F21V 29/67; F21V 29/673; F21V 29/677
See application file for complete search history.

(56) References Cited

U.S. PATENT DOCUMENTS 5,779,353 A 7/1998 Kacheria
7,425,793 B2 * 9/2008 Haga ..... G03B 21/16 313/46
(Continued)

FOREIGN PATENT DOCUMENTS

CN 104315476 A 1/2015
CN 204213873 U 3/2015
(Continued)

OTHER PUBLICATIONS

International Search Report for Application No. PCT/CN2016/099610, dated May 24, 2017.

*Primary Examiner* — Alexander K Garlen
(74) *Attorney, Agent, or Firm* — Lerner, David, Littenberg, Krumholz & Mentlik, LLP

(57) ABSTRACT

The disclosure relates to stage lighting fixtures, and in particular to a stage lighting fixture thermal system capable of dynamically adjusting air flow delivery. This stage lighting fixture thermal system comprises a light source and a heat dissipation chamber. Light source is arranged inside heat dissipation chamber. An illuminating side of light source faces a light outlet on a top part of heat dissipation chamber. The stage lighting fixture thermal system further comprises at least one first air supply mechanism communicated with heat dissipation chamber. The first air supply mechanism is dynamically arranged on heat dissipation chamber. The stage lighting fixture thermal system has a simple structure and is convenient to use. It may adjust, according to position change of light source, the air supply mechanism to an optimal position for heat dissipation to prolong life of the light source.

10 Claims, 4 Drawing Sheets

(51) Int. Cl.
*F21V 29/67* (2015.01)
*F21V 29/76* (2015.01)
*F21W 131/406* (2006.01)

(52) U.S. Cl.
CPC ..... *F21V 29/76* (2015.01); *F21W 2131/406* (2013.01)

(56) References Cited

U.S. PATENT DOCUMENTS

| | | | | |
|---|---|---|---|---|
| 8,393,738 | B2 * | 3/2013 | Lo | G03B 21/16 353/57 |
| 2004/0228130 | A1 * | 11/2004 | Kato | F21V 29/02 362/294 |
| 2004/0246447 | A1 * | 12/2004 | Shiraishi | G03B 21/16 353/58 |
| 2011/0051098 | A1 * | 3/2011 | Kobayashi | G03B 21/16 353/61 |
| 2011/0216287 | A1 * | 9/2011 | Kitamura | G03B 21/16 353/61 |
| 2012/0287408 | A1 * | 11/2012 | Yamashita | F21V 29/02 353/61 |
| 2016/0040866 | A1 * | 2/2016 | Quadri | F21V 29/67 362/373 |
| 2016/0305639 | A1 * | 10/2016 | Midali | F21V 29/60 |
| 2017/0097151 | A1 * | 4/2017 | Quadri | F21V 29/673 |

FOREIGN PATENT DOCUMENTS

| | | | |
|---|---|---|---|
| CN | 205014170 | U | 2/2016 |
| CN | 105822958 | A | 8/2016 |
| CN | 205991468 | U | 3/2017 |

* cited by examiner

STAGE LIGHTING FIXTURE THERMAL SYSTEM CAPABLE OF DYNAMICALLY ADJUSTING AIR FLOW DELIVERY

CROSS-REFERENCE TO RELATED APPLICATION

The present application is a continuation of International Application No. PCT/CN2016/099610 filed Sep. 21, 2016, which claims priority from Chinese Patent Application No. 201610706284.5 filed Aug. 23, 2016, the disclosures of which are hereby incorporated herein by reference.

TECHNICAL FIELD

The disclosure relates to the technical field of stage lighting fixtures, and in particular to a stage lighting fixture's thermal system capable of dynamically adjusting air flow delivery.

BACKGROUND

Stage lighting fixtures generally have relatively high power consumption when in use. In particular, the light source can generate a large quantity of heat when it is illuminated, which impacts the effects and life of the lamp; therefore, the light source of the stage lighting fixture needs to be cooled.

In prior art, it is normal to dissipate heat by an air blower or fan in combination with a heat radiator. However, the air blower or fan is generally in a fixed position. When in use, a tuyere associated with the air blower or fan cannot be adjusted in real time relative to the position of the light source. However, when the stage lighting fixture is in use, in order to change the light outputting position, a lamp is frequently swung and rotated, so that the position of the lamp is changed and thus the position of the light source is changed in real time. Due to the fact that the tuyere associated with the air blower or fan cannot be adjusted in real time relative to the position of the light source, if the lamp is placed horizontally, the temperature difference between the upper side and lower side of the light source is big; if the lamp is placed vertically, the temperature difference between the left side and right side of the light source is big; if the lamp is placed obliquely, the differences of the temperature between the upper side and lower side and between the left side and right side of the light source are big; thus, the life of the light source is seriously impacted.

SUMMARY

In order to remedy at least one of the above drawbacks of the prior art, the disclosure provides a stage lighting fixture thermal system capable of dynamically adjusting air flow delivery, which is simple in structure and convenient to use, and may adjust, according to the position of a light source, an air supply mechanism to an optimal position for heat dissipation, so that the life of the light source is prolonged.

In order to solve the above technical problem, the disclosure employs a technical scheme as follows. A stage lighting fixture thermal system capable of dynamically adjusting air flow delivery includes a light source and a heat dissipation chamber; the light source is arranged inside the heat dissipation chamber; an illuminating side of the light source faces a light outlet on a top part of the heat dissipation chamber; herein, the stage lighting fixture thermal system further includes at least one first air supply mechanism communicated with the heat dissipation chamber; the first air supply mechanism is an air supply mechanism that is able to move; the first air supply mechanism is dynamically arranged on the heat dissipation chamber; and, when the position of the light source changes with the movement of the stage lighting fixture, the first air supply mechanism may move, according to the position of the light source, to a corresponding optimal position to direct air towards the light source and cool the lamp more efficiently.

Further, two first air supply mechanisms are provided, which are arranged on the heat dissipation chamber corresponding to upper and lower parts of the light source respectively.

Further, an air outlet side of the first air supply mechanism is provided with an air outlet cover body; the air outlet cover body, the heat dissipation chamber and the first air supply mechanism enclose an air outlet cavity; and an air outlet is arranged on the air outlet cover body. An air inlet is arranged at a position on the heat dissipation chamber corresponding to the air outlet, and the air inlet is communicated with the air outlet. Preferably, the air inlet is greater than the air outlet in size, and the air inlet defines a displacement space for the movement of the air outlet; during the movement process of the air outlet, the portion of the air inlet not directly facing the air outlet is blocked by the air outlet cover body, so as to avoid the situation that the cold air supplied to the heat dissipation chamber by the first air supply mechanism through the air outlet escapes through the air inlet.

Further, a drive device is arranged below the first air supply mechanism, the drive device is connected on the heat dissipation chamber and the drive device is connected with the first air supply mechanism. The drive device includes a drive motor and a transmission mechanism, and the transmission mechanism is connected to the drive motor and the first air supply mechanism respectively.

Further, the transmission mechanism includes a transmission guide rod, a sliding block and a driving gear; the first air supply mechanism is connected on the sliding block; the sliding block is sleeved on the transmission guide rod, and one side of the sliding block is provided with a rack; the rack is engaged with the driving gear; and the driving gear is connected on an output shaft of the drive motor. The drive motor drives the driving gear to move, and the driving gear drives in sequence the rack and the sliding block to move on the transmission guide rod, thereby driving the air outlet of the first air supply mechanism to perform linear movement along the air inlet of the heat dissipation chamber, so that the air outlet of the first air supply mechanism is adjusted to an optimal position relative to the light source.

Further, the stage lighting fixture thermal system further includes a position detection device; the position detection device includes a position detection gear and a sensor; and the position detection gear is sleeved on the output shaft of the drive motor and the sensor is arranged on the transmission mechanism. As a preferred embodiment, the sensor is an optoelectronic switch preferably. The movement of the position detection gear is consistent with the movement of the driving gear, so that the position state of the driving gear is conveniently detected. The sensor is connected with a control system of the stage lighting fixture through a control signal. The position detection gear may detect the position of the driving gear in real time, thereby detecting indirectly the position of the air outlet of the first air supply mechanism relative to the light source in real time and sending the detected position to the control system through the sensor; then, the control system judges whether the current position state of the air outlet of the first air supply mechanism is an optimal position; if the current position state of the air outlet is not the optimal position corresponding to the current position state of the lamp (the position state of the light source), the control system feeds back a signal to the drive motor, so that the drive device drives the air outlet of the first air supply mechanism to move to the optimal position linearly along the air inlet on the heat dissipation chamber, so as to meet the requirement of heat dissipation for the light source.

The position of the first air supply mechanism may be set according to actual use requirements. The first air supply mechanism may be arranged at any part of the peripheral of the heat dissipation chamber. In the scheme of the disclosure, the first air supply mechanism preferably is arranged at the upper part of the heat dissipation chamber, thus, the cold air supplied by the first air supply mechanism may be blown to the illuminating side and upper half part of the light source, so that, when the position of the light source changes with the movement of the lamp, the first air supply mechanism may move according to position of the light source to a corresponding optimal position to blow air towards the light source and make it cool. Of course, besides the above manner, the first air supply mechanism also may be arranged at the middle part, lower part or any other part of the outer side of the heat dissipation chamber.

In addition, the first air supply mechanism also can be provided as multiple ones. Through the combined use of the multiple first air supply mechanisms which are arranged at different parts of the outer side of the heat dissipation chamber, sufficient heat dissipation is realized. As an embodiment, two first air supply mechanisms can be provided which are arranged at upper and lower parts of different sides of the heat dissipation chamber respectively.

As another preferred scheme, the stage lighting fixture thermal system further includes a second air supply mechanism communicated with the heat dissipation chamber; the second air supply mechanism is an immoveable air supply mechanism and is arranged on the heat dissipation chamber. The structure of the second air supply mechanism is fixed, that is, the second air supply mechanism is fixedly mounted on the outer side of the heat dissipation chamber.

Likewise, the position of the second air supply mechanism also may be set according to actual use requirements. The second air supply mechanism may be arranged at any part of the peripheral of the heat dissipation chamber. In the scheme of the disclosure, the second air supply mechanism preferably is arranged at the lower part of the outer side of the heat dissipation chamber, thus, the cold air supplied by the second air supply mechanism may be blown to the lower half part of the light source. Of course, besides the above manner, the second air supply mechanism also may be arranged at the upper part, middle part or any other part of the outer side of the heat dissipation chamber.

In the disclosure, the first air supply mechanism and the second air supply mechanism are both air blowers preferably, and can also be other devices capable of generating air currents or pumping external air currents.

In the disclosure, a heat radiator is arranged at the bottom of the heat dissipation chamber; and the heat radiator includes a fin fixation frame, and radiating fins fixed on the fin fixation frame, wherein the radiating fins are provided spaced apart and arranged side by side on the fin fixation frame, and the space between each radiating fin defines a heat dissipation channel, through which the heat inside the heat dissipation chamber, which is generated by the light source, can be emitted from the lamp along with the air current.

Compared with prior art, beneficial effects of the disclosure are as follows.

According to the technical scheme of the disclosure, the air supply mechanism is moveable. When the light source is at different positions, the air supply mechanism can be located to the optimal position through the drive device controlled by the control system, in accordance with a software program design, so that the differences of the temperature between the upper side and lower side and between the left side and right side of the light source are reduced to the normal use range; therefore, the life of the light source is greatly prolonged.

DESCRIPTION OF THE EMBODIMENTS

Figure 1:
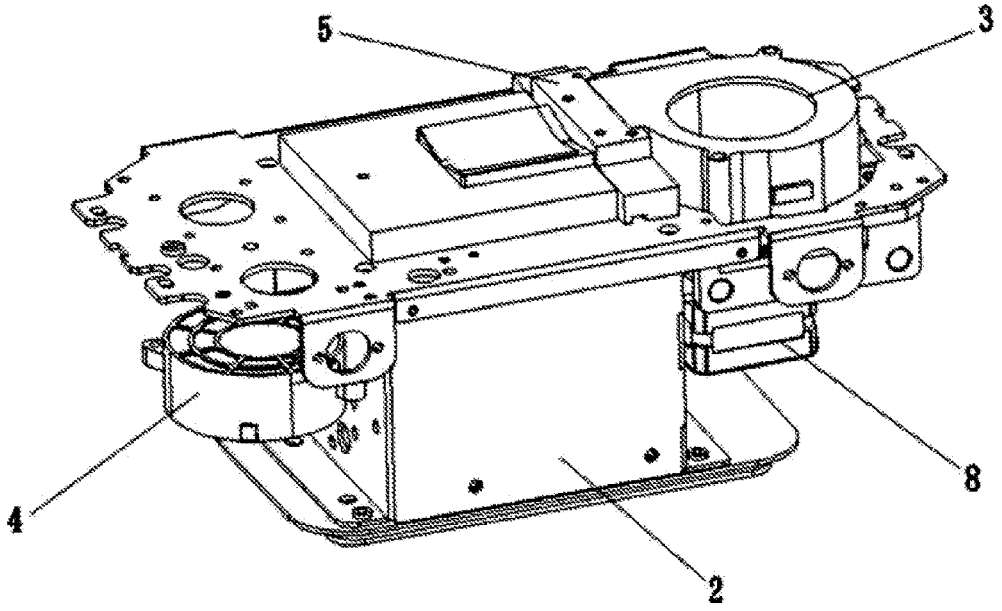
FIG. 1 is an overall structural diagram of the disclosure.

The drawings are merely for exemplary illustration, but cannot be understood as a restriction to the patent of the disclosure. To better illustrate the embodiments, some parts in the drawings may be omitted, enlarged or reduced, and the sizes do not represent the actual sizes of the products. For those skilled in the art, it is understandable that some known structures in the drawings and descriptions thereof probably are omitted. The positional relations described in the drawings are merely for exemplary illustration, but cannot be understood as a restriction to the patent of the disclosure.

Embodiment 1

As shown in FIG. 1 to FIG. 4, a stage lighting fixture thermal system capable of dynamically adjusting air flow delivery includes a light source 1 and a heat dissipation chamber 2; the light source 1 is arranged inside the heat dissipation chamber 2; an illuminating side of the light source 1 faces a light outlet on a top part of the heat dissipation chamber 2; herein, the stage lighting fixture thermal system further includes a first air supply mechanism 3 communicated with the heat dissipation chamber 2, and the first air supply mechanism 3 is dynamically arranged on the heat dissipation chamber 2. Of course, the first air supply mechanism also can be provided as multiple ones. Through the combined use of the multiple first air supply mechanisms which are arranged at different parts of the outer side of the heat dissipation chamber, sufficient heat dissipation is realized.

The position of the first air supply mechanism 3 may be set according to actual use requirements. The first air supply mechanism 3 may be arranged at any part of the peripheral of the heat dissipation chamber. In this embodiment, in order to achieve a better heat dissipation effect, the first air supply mechanism 3 preferably is arranged at the upper part of the heat dissipation chamber 2, so that the cold air supplied by the first air supply mechanism 3 may be blown to the illuminating side and upper half part of the light source 1; moreover, when the position of the light source 1 changes with the movement of the lamp, the first air supply mechanism 3 may move, according to position of the light source, to a corresponding optimal position to blow air towards the light source 1 and reduce the temperature of the lightsource. Of course, besides the above manner, the first air supply mechanism 3 also may be arranged at the middle part, lower part or any other part of the outer side of the heat dissipation chamber 2.

Figure 2:
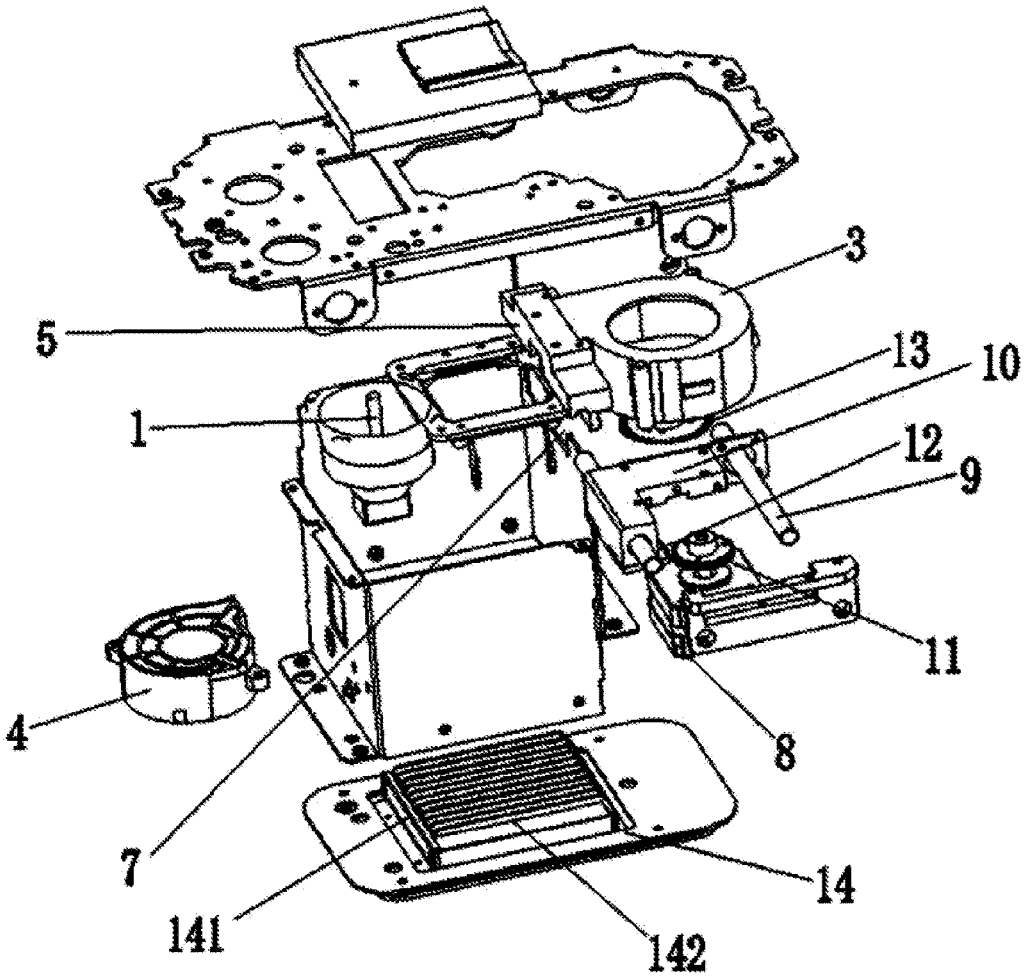
FIG. 2 is an exploded view of FIG. 1.
Figure 3:
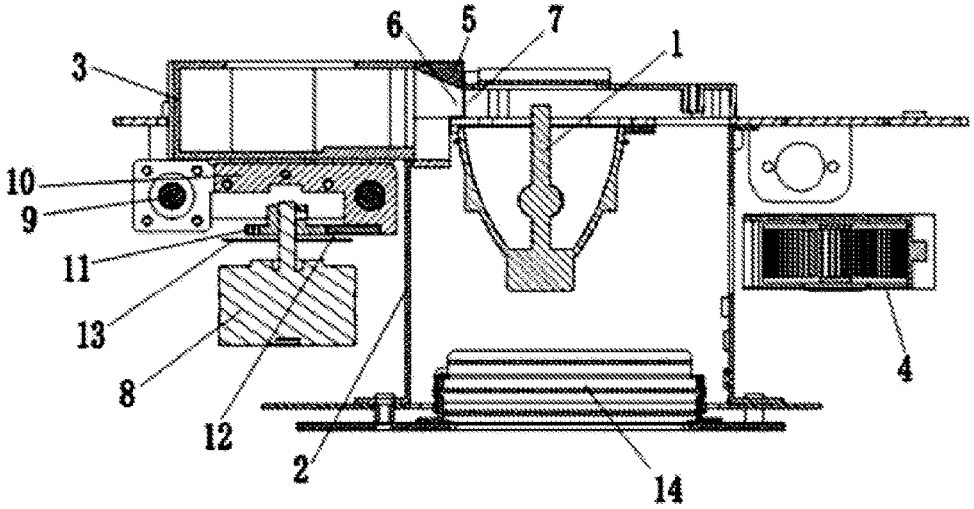
FIG. 3 is a longitudinal sectional view of the disclosure.
Figure 5:
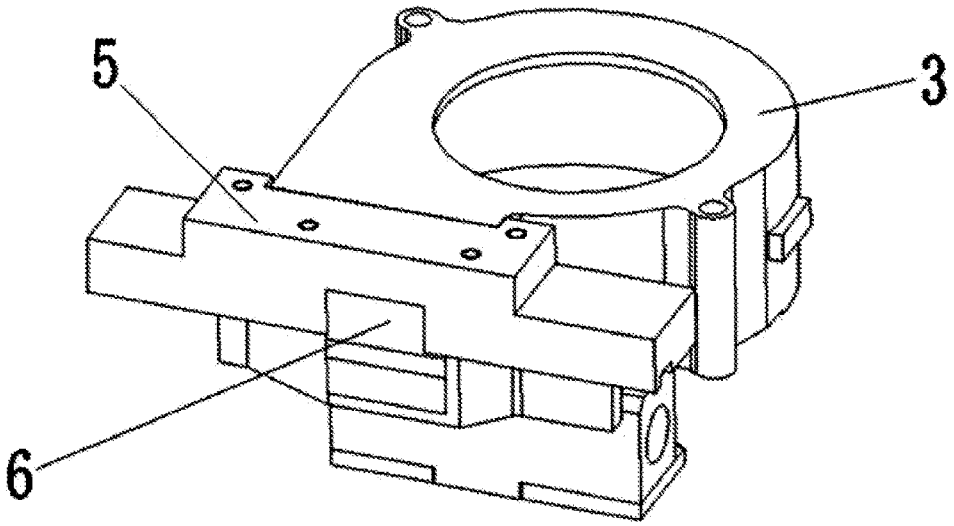
FIG. 5 is a structural diagram of a first air supply mechanism of the disclosure.

As shown in FIG. 1 to FIG. 3 and in FIG. 5, an air outlet side of the first air supply mechanism 3 is provided with an air outlet cover body 5; the air outlet cover body 5, the heat dissipation chamber 2 and the first air supply mechanism 3 enclose an air outlet cavity; and an air outlet 6 is arranged on the air outlet cover body 5. An air inlet 7 is arranged at a position on the heat dissipation chamber 2 corresponding to the air outlet 6, and the air inlet 7 is communicated with the air outlet 6. The air inlet 7 is greater than the air outlet 6 in size, and the air inlet 7 defines a displacement space for the movement of the air outlet 6; during the movement process of the air outlet 6, the portion of the air inlet 7 not directly facing the air outlet 6 is blocked by the air outlet cover body 5, so as to avoid the situation that the cold air supplied to the heat dissipation chamber 2 by the first air supply mechanism 3 through the air outlet 6 escapes through the air inlet 7.

As shown in FIG. 1 to FIG. 4, a drive device is arranged below the first air supply mechanism 3, the drive device is connected on the heat dissipation chamber 2 and the drive device is connected with the first air supply mechanism 3. The drive device includes a drive motor 8 and a transmission mechanism, and the transmission mechanism is connected to the drive motor 8 and the first air supply mechanism 3 respectively.

Figure 4:
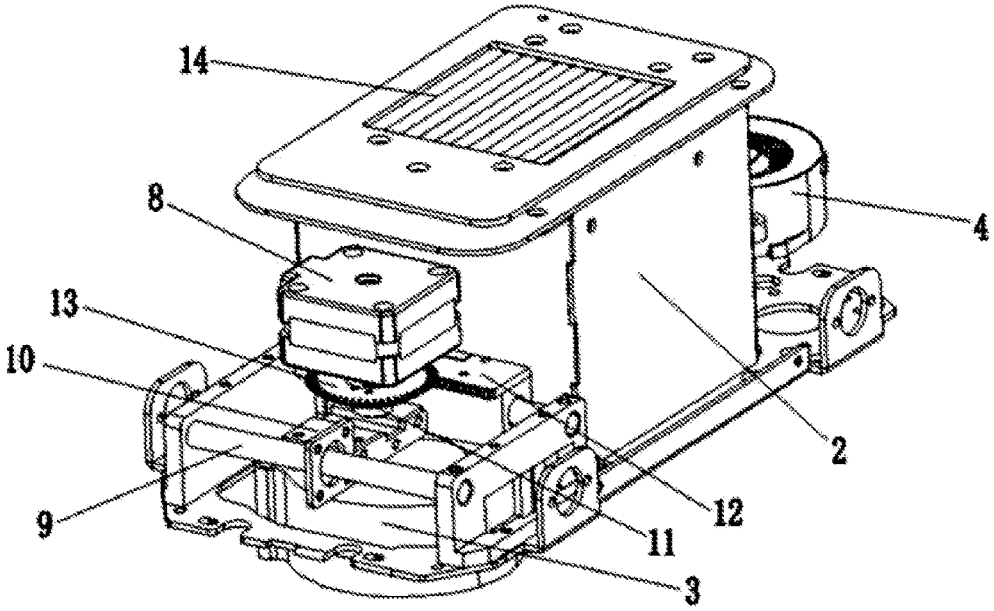
FIG. 4 is an overall structural diagram of the disclosure.

As shown in FIG. 2 to FIG. 4, the transmission mechanism includes a transmission guide rod 9, a sliding block 10 and a driving gear 11; the first air supply mechanism 3 is connected on the sliding block 10; the sliding block 10 is sleeved on the transmission guide rod 9, and one side of the sliding block 10 is provided with a rack 12; the rack 12 is engaged with the driving gear 11; and the driving gear 11 is connected on an output shaft of the drive motor 8. The drive motor 8 drives the driving gear 11 to move, and the driving gear 11 drives in sequence the rack 12 and the sliding block 10 to move on the transmission guide rod 9, thereby driving the air outlet 6 of the first air supply mechanism 3 to perform linear movement along the air inlet 7 of the heat dissipation chamber 2, so that the air outlet 6 of the first air supply mechanism 3 is adjusted to an optimal position relative to the light source 1.

As shown in FIG. 2 to FIG. 4, the stage lighting fixture thermal system further includes a position detection device; the position detection device includes a position detection gear 13 and a sensor. In this embodiment, the sensor is an optoelectronic switch preferably, the position detection gear 13 is sleeved on the output shaft of the drive motor 8, and the optoelectronic switch is arranged on the transmission mechanism. The movement of the position detection gear 13 is consistent with the movement of the driving gear 11, so that the position state of the driving gear 11 is conveniently detected. The optoelectronic switch is connected with a control system of the stage lighting fixture through a control signal. The position detection gear 13 may detect the position of the driving gear 11 in real time, thereby detecting indirectly the position of the air outlet 6 of the first air supply mechanism 3 relative to the light source 1 in real time and sending the detected position to the control system through the optoelectronic switch; then, the control system judges whether the current position state of the air outlet 6 of the first air supply mechanism 3 is an optimal position; if the current position state of the air outlet is not the optimal position corresponding to the current position state of the lamp (the position state of the light source 1), the control system feeds back a signal to the drive motor 8, so that the drive device drives the air outlet 6 of the first air supply mechanism 3 to move to the optimal position linearly along the air inlet 7 on the heat dissipation chamber 2, so as to meet the requirement of heat dissipation for the light source 1.

In this embodiment, the first air supply mechanism 3 is an air blower preferably, and can also be other devices capable of generating air currents or pumping external air currents.

As shown in FIG. 2 to FIG. 4, a heat radiator 14 is arranged at the bottom of the heat dissipation chamber 2; and the heat radiator 14 includes a fin fixation frame 141, and radiating fins 142 fixed on the fin fixation frame 141, wherein the radiating fins 142 are provided spaced apart and arranged side by side on the fin fixation frame 141, and the space between each radiating fin 142 defines a heat dissipation channel, through which the heat inside the heat dissipation chamber 2, which is generated by the light source 1, can be emitted from the lamp along with the air current.

Embodiment 2

This embodiment is similar to the Embodiment 1, with a difference as follows. As shown in FIG. 1 to FIG. 4, the stage lighting fixture thermal system further includes a second air supply mechanism 4 communicated with the heat dissipation chamber 2. The position of the second air supply mechanism 4 may be set according to actual use requirements. The second air supply mechanism 4 may be arranged at any part of the peripheral of the heat dissipation chamber. In this embodiment, in order to achieve a better heat dissipation effect, the second air supply mechanism 4 preferably is arranged at the lower part of the outer side of the heat dissipation chamber 2, so as to blow air towards the lower half part of the light source 1 and reduce the temperature of the lightsource. The structure of the second air supply mechanism 4 is fixed, that is, the second air supply mechanism 4 is fixedly mounted on the outer side of the lower part of the heat dissipation chamber 2. The air outlet of the second air supply mechanism 4 is communicated with the internal of the heat dissipation chamber 2.

Of course, besides the above manner, the second air supply mechanism also may be arranged at the upper part, middle part or any other part of the outer side of the heat dissipation chamber.

The second air supply mechanism 4 is an air blower preferably, and can also be other devices capable of generating air currents or pumping external air currents.

Embodiment 3

This embodiment is similar to the Embodiment 1, with a difference as follows. Two first air supply mechanisms 3 are provided, which are arranged at upper and lower parts of the heat dissipation chamber 2 respectively (that is, on the heat dissipation chamber 2 corresponding to upper and lower parts of the light source 1 respectively). The two first air supply mechanisms 3 may be arranged at the same side, or may be arranged at different sides. The two first air supply mechanisms 3 cool the illuminating side and the upper and lower parts of the light source respectively. Each first air supply mechanism 3, and respective drive device and position detection device all employ the same structure as the Embodiment 1. The working principle of the first air supply mechanism 3 is the same as that of the first air supply mechanism 3 in the Embodiment 1.

Obviously, the above embodiments of the disclosure are examples made merely to clearly describe the disclosure, and are not a limit to the implementation of the disclosure. For the ordinary skill in this filed, other different forms of variations or changes also may be made on the basis of the above description. It is not necessary or unable to make an exhaustion of all implementations. Any modifications, equivalent substitutions and changes and the like made within the spirit and principle of the disclosure all are intended to be included in the scope of protection of the claims of the disclosure.

What is claimed is:

1. A stage lighting fixture thermal system capable of dynamically adjusting air flow delivery, comprising, a light source and a heat dissipation chamber, the light source being arranged inside the heat dissipation chamber, wherein the stage lighting fixture thermal system further comprises at least one first air supply mechanism connected with the heat dissipation chamber, and the first air supply mechanism is dynamically arranged on the heat dissipation chamber;

a drive device connected below the first air supply mechanism, wherein the drive device is connected on the heat dissipation chamber;

wherein the drive device further includes a drive motor and a transmission mechanism, and the transmission mechanism is connected to the drive motor and the first air supply mechanism respectively; and wherein the drive motor drives an air outlet of the first air supply mechanism to move linearly along an air inlet of the heat dissipation chamber, so that the air outlet of the first air supply mechanism is adjusted to an optimal position relative to the light source.

2. The stage lighting fixture thermal system capable of dynamically adjusting air flow delivery according to claim 1, wherein the first air supply mechanism is provided as two first air supply mechanisms which are arranged on the heat dissipation chamber corresponding to upper and lower parts of the light source respectively.

3. The stage lighting fixture thermal system capable of dynamically adjusting air flow delivery according to claim 1, wherein an air outlet side of the first air supply mechanism is provided with an air outlet cover body; the air outlet cover body, the heat dissipation chamber and the first air supply mechanism enclose an air outlet cavity; and the air outlet is arranged on the air outlet cover body.

4. The stage lighting fixture thermal system capable of dynamically adjusting air flow delivery according to claim 3, wherein the air inlet is arranged at a position on the heat dissipation chamber corresponding to the air outlet, and the air inlet is communicated with the air outlet.

5. The stage lighting fixture thermal system capable of dynamically adjusting air flow delivery according to claim 1, wherein the transmission mechanism comprises a transmission guide rod, a sliding block and a driving gear; the first air supply mechanism is connected on the sliding block; the sliding block is sleeved on the transmission guide rod, and one side of the sliding block is provided with a rack; the rack is engaged with the driving gear; and the driving gear is connected on an output shaft of the drive motor.

6. The stage lighting fixture thermal system capable of dynamically adjusting air flow delivery according to claim 5, wherein the stage lighting fixture thermal system further comprises a position detection device; the position detection device comprises a position detection gear and a sensor; and the position detection gear is sleeved on the output shaft of the drive motor and the sensor is arranged on the transmission mechanism.

7. The stage lighting fixture thermal system capable of dynamically adjusting air flow delivery according to claim 1, wherein the first air supply mechanism is an air blower.

8. The stage lighting fixture thermal system capable of dynamically adjusting air flow delivery according to claim 1, wherein the stage lighting fixture thermal system further comprises a second air supply mechanism communicated with the heat dissipation chamber, and the second air supply mechanism is arranged on the heat dissipation chamber.

9. The stage lighting fixture thermal system capable of dynamically adjusting air flow delivery according to claim 8, wherein the second air supply mechanism is fixedly mounted on the outer side of the heat dissipation chamber.

10. The stage lighting fixture thermal system capable of dynamically adjusting air flow delivery according to claim 1, wherein a heat radiator is arranged at the bottom of the heat dissipation chamber; and the heat radiator comprises a fin fixation frame, and radiating fins fixed on the fin fixation frame, wherein the radiating fins are provided spaced apart and arranged side by side on the fin fixation frame.

* * * * *